US007656080B2

(12) United States Patent
Hernandez, Jr. et al.

(10) Patent No.: US 7,656,080 B2
(45) Date of Patent: Feb. 2, 2010

(54) VIBRATION RESISTANT, ENERGY EFFICIENT LAMP

(75) Inventors: Fred Hernandez, Jr., Ipswich, MA (US); Catherine M. Emerling, Salem, MA (US); Joe Wang, Guangdong (CN); Chin Shui Hsu, Hsinchu (TW)

(73) Assignees: Osram Sylvania Inc., Danvers, MA (US); Everlite Electric Ind. Corp., Tangxia Town, Dongquan Guangdong (CN)

( * ) Notice: Subject to any disclaimer, the term of this patent is extended or adjusted under 35 U.S.C. 154(b) by 526 days.

(21) Appl. No.: 11/788,883

(22) Filed: Apr. 23, 2007

(65) Prior Publication Data

US 2008/0258620 A1 Oct. 23, 2008

(51) Int. Cl.
*H01J 5/02* (2006.01)

(52) U.S. Cl. ..... 313/317; 313/318.01

(58) Field of Classification Search ..... 313/25, 313/317, 318, 318.01–318.12; 445/24, 26
See application file for complete search history.

(56) References Cited

U.S. PATENT DOCUMENTS

D541,440 S 4/2007 Feit

2004/0017156 A1* 1/2004 Yasuda et al. ..... 315/56

* cited by examiner

*Primary Examiner*—Joseph L Williams
*Assistant Examiner*—Fatima N Farokhrooz
(74) *Attorney, Agent, or Firm*—William H. McNeill; Shaun P. Montana

(57) ABSTRACT

A vibration resistant, energy efficient lamp (10) that is suitable for, for example, ceiling fan operation where vibration is always a concern. The lamp (10) comprises an envelope (12) of a suitable transparent glass, for example, a borosilicate glass, having a substantially spherical upper body (14) with a given diameter D, a substantially cylindrical waist (16) having a diameter W of about 38% of the given diameter; a neck portion (18) having a diameter N of about 31 to about 32% of the given diameter and a threaded base (20) having a diameter B of about 25 to 27% of the given diameter. The base (20) has a skirt portion (22) adjacent the neck portion having diameter S substantially equal to the neck portion (18) diameter N and larger than the diameter B of the base (20). The skirt (22) provides a broader attachment area for the neck (18), thus strengthening the coupling and providing a stronger joint that is more suited to operations in those functions where vibration can be encountered, especially in those areas where the lamp is mounted base-up.

5 Claims, 2 Drawing Sheets

VIBRATION RESISTANT, ENERGY EFFICIENT LAMP

TECHNICAL FIELD

This invention relates to lamps and more particularly to vibration resistant, energy efficient lamps primarily for use in ceiling fans or like fixtures.

BACKGROUND ART

Ceiling fans often employ one or more light sources such as lamps. These lamps generally are ruggedized in some manner to withstand the vibrations that can exist, even in a well-balanced fan, when it is operating.

Recent demands for more energy efficiency in such lamps has focused on the medium Edison base employed by these lamps, since this relatively large metal base is the source of extensive heat losses. Attempts to merely reduce the base size, for example, by substituting a conventional candelabra base, have proven to be unworkable because the reduced neck size of the lamp envelope in combination with the smaller base left the lamp weakly attached to the base and subject to separation, causing the lamp envelope to occasionally fall from the fixture.

DISCLOSURE OF INVENTION

It is, therefore, an object of the invention to obviate the disadvantages of the prior art.

It is another object of the invention to provide an enhanced lamp.

These objects are accomplished, in one aspect of the invention, by a vibration resistant, energy efficient lamp comprising: an envelope having a substantially spherical body with a given diameter D, a substantially cylindrical waist having a diameter W of about 38% of the given diameter; a neck portion having a diameter N of about 31 to about 32% of the given diameter and a threaded base having a diameter B of about 25 to 27% of the given diameter, the base having a skirt portion adjacent the neck portion having diameter S substantially equal to the neck portion diameter N and larger than the diameter B.

Reduction of the base in a lamp of this size reduces energy lost via the base and the addition of the skirt provides adequate volume to insure good adhesion of the glass envelope to the base, thus increasing its vibration resistance.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 4:
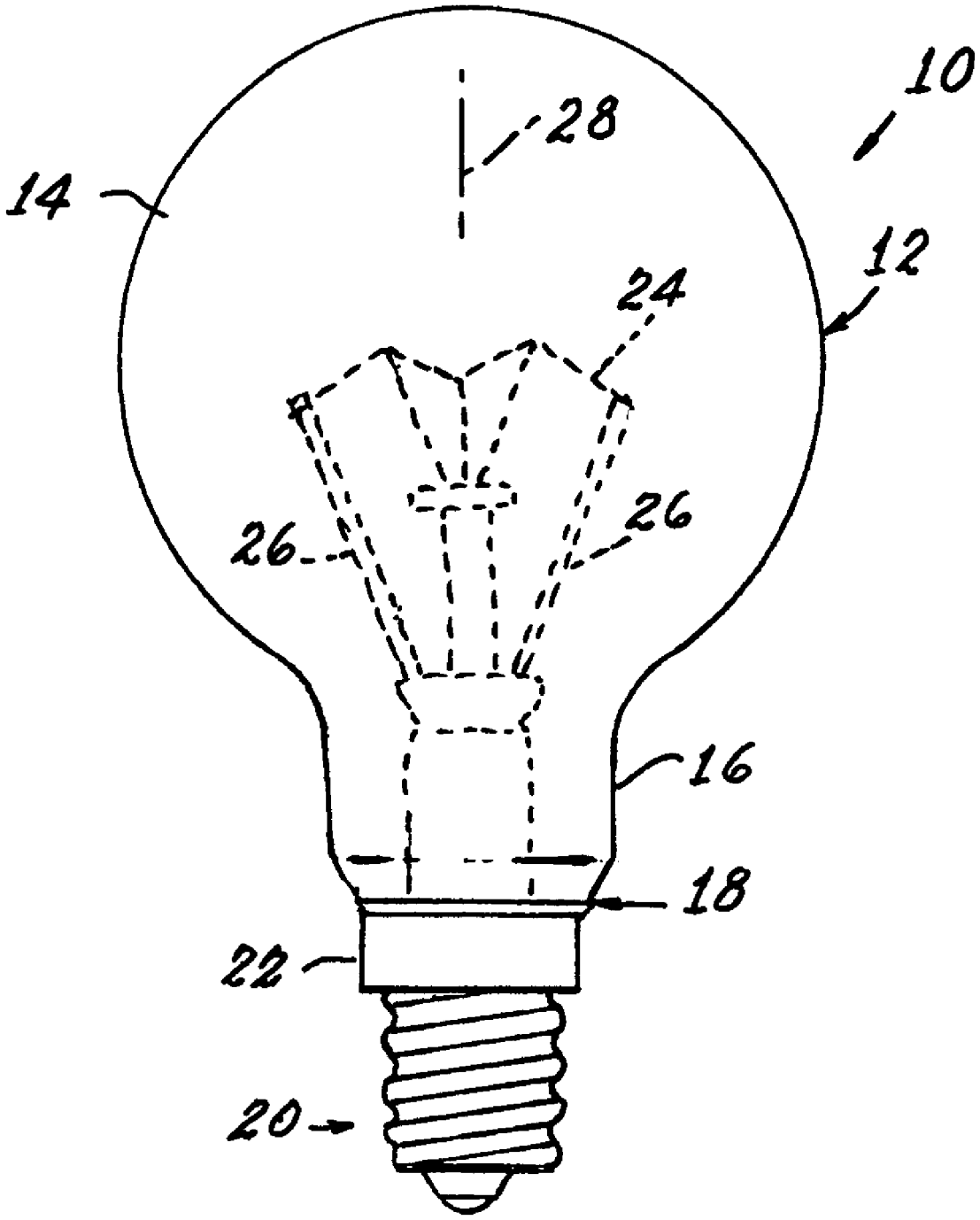
FIG. 4 is a numbered, elevational view of the lamp of FIG. 1.

Referring now to the drawings with greater particularity, there is shown in FIG. 4 a vibration resistant, energy efficient lamp 10 that is suitable for, for example, ceiling fan operation where vibration is always a concern. The lamp 10 comprises an envelope 12 of a suitable transparent glass, for example, a borosilicate glass, having a substantially spherical upper body 14 with a given diameter D, a substantially cylindrical waist 16 having a diameter W of about 38% of the given diameter; a neck portion 18 having a diameter N of about 31 to about 32% of the given diameter and a threaded base 20 having a diameter B of about 25 to 27% of the given diameter. The base 20 has a skirt portion 22 adjacent the neck portion having diameter S substantially equal to the neck portion 18 diameter N and larger than the diameter B of the base 20. The skirt 22 provides a broader attachment area for the neck 18, thus strengthening the coupling and providing a stronger joint that is more suited to operations in those functions where vibration can be encountered.

The lamp 10 contains an incandescent filament 24 supported by at least three supports 26. In the illustrated embodiment, five supports 26 are utilized. Preferably, the envelope 12 is gas-filled, for example, with nitrogen at a pressure of 580±30 torr.

Two of the supports 26 can be extensions of the electrical lead-ins for the lamp, which are connected to the base 20 as is conventional.

Figure 1:
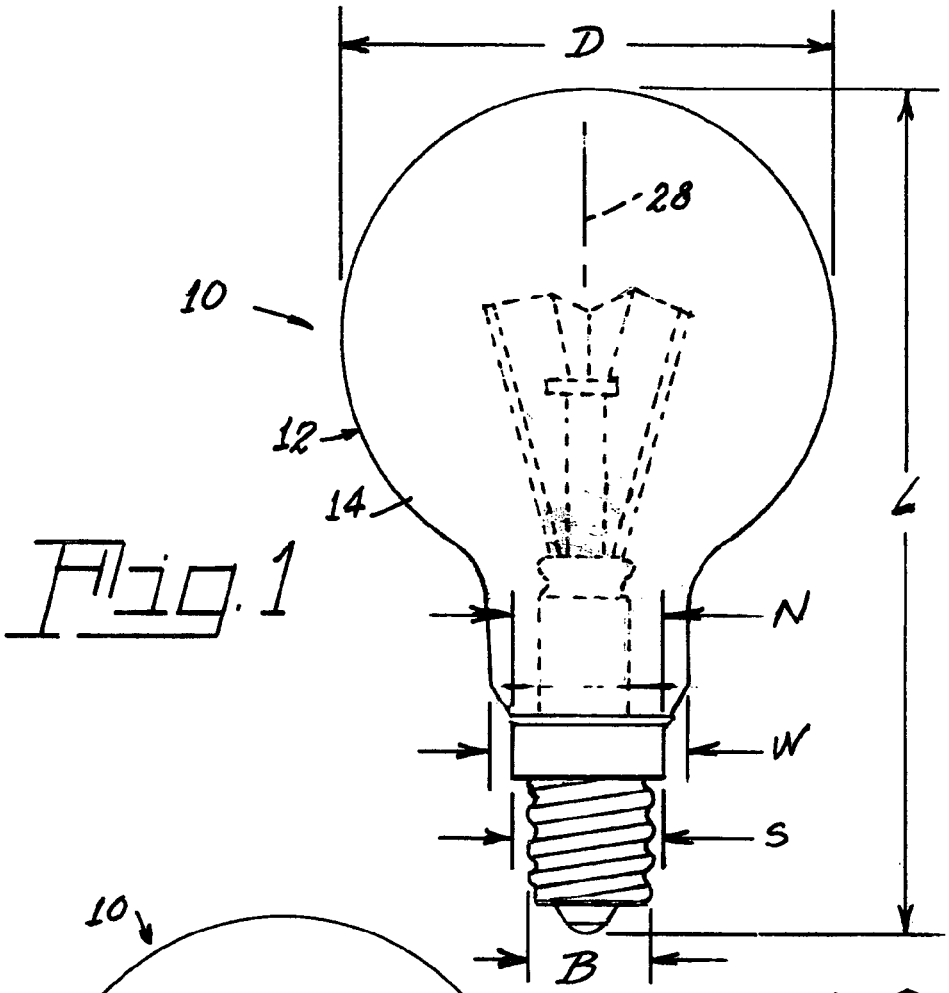
FIG. 1 is an elevational view of a lamp according to an aspect of the invention, illustrating the proportions.
Figure 2:
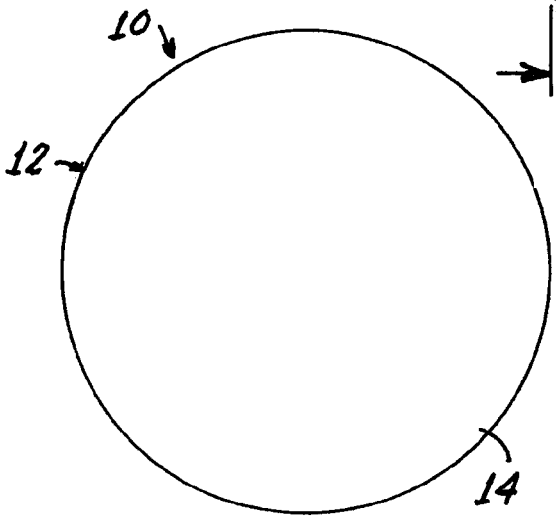
FIG. 2 is a top view of the lamp of FIG. 1.
Figure 3:
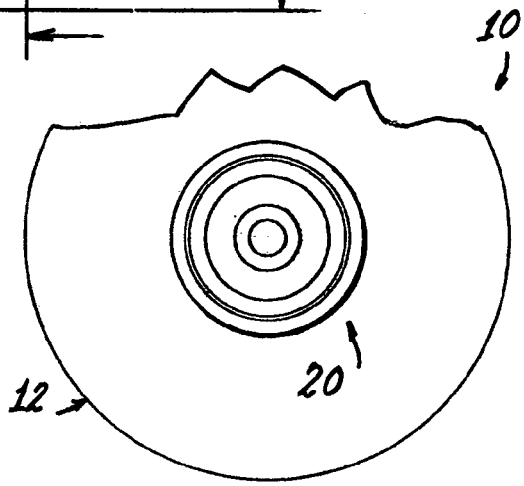
FIG. 3 is a bottom plan view of the lamp of FIG. 1.

The envelope 12 is symmetrically arrayed about a longitudinal axis 28 and the lamp 10 has an overall length L, measured along the longitudinal axis 28 and shown in FIG. 1, of about 172 to 180% of the given diameter D. The variation in length is a result of manufacturing tolerances. For example, when the envelope is an A15 configuration, that is, having a diameter D of 15/8 inches (47.6 mm) (a closely controlled dimension) the length will be 84 mm, with a tolerance of ±2 mm.

Thus there is provided an energy efficient, vibration resistant lamp that is suitable for ceiling fan operation or other areas where vibration could be a cause for concern.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A vibration resistant, energy efficient lamp comprising:

an envelope having a substantially spherical body with a given diameter D;

a substantially cylindrical waist having a diameter W of about 38% of said given diameter;

a neck portion having a diameter N of about 31 to about 32% of said given diameter;

and a threaded base having a diameter B of about 25 to 27% of said given diameter, said base having a skirt portion adjacent said neck portion having diameter S substantially equal to said neck portion diameter N and larger than said diameter B.

2. The lamp of claim 1 wherein said lamp contains an incandescent filament supported by at least three supports.

3. The lamp of claim 1 wherein said envelope is symmetrically arrayed about a longitudinal axis.

4. The lamp of claim 2 wherein said envelope is gas-filled.

5. The lamp of claim 3 wherein said longitudinal axis has a length 1 of about 172 to 180% of said given diameter.

* * * * *